US008917231B2

(12) United States Patent
Hempson et al.

(10) Patent No.: US 8,917,231 B2
(45) Date of Patent: Dec. 23, 2014

(54) REGULATION OF GAMMA CHARACTERISTIC IN A DISPLAY

(75) Inventors: Kevin Hempson, Los Gatos, CA (US); Dilip Sangam, Saratoga, CA (US)

(73) Assignee: Atmel Corporation, San Jose, CA (US)

( * ) Notice: Subject to any disclaimer, the term of this patent is extended or adjusted under 35 U.S.C. 154(b) by 871 days.

(21) Appl. No.: 12/972,380

(22) Filed: Dec. 17, 2010

(65) Prior Publication Data

US 2012/0154462 A1 Jun. 21, 2012

(51) Int. Cl.
*G09G 3/36* (2006.01)
*G09G 3/34* (2006.01)

(52) U.S. Cl.
CPC ..... *G09G 3/342* (2013.01); *G09G 3/3426* (2013.01); *G09G 2320/0276* (2013.01); *G09G 2320/0646* (2013.01); *G09G 2320/064* (2013.01); *G09G 2320/0261* (2013.01)
USPC ..... 345/102

(58) Field of Classification Search
USPC ..... 345/102
See application file for complete search history.

(56) References Cited

U.S. PATENT DOCUMENTS

2009/0015536 A1* 1/2009 Takeoka et al. ..... 345/99
2010/0277494 A1* 11/2010 Cho et al. ..... 345/88

* cited by examiner

*Primary Examiner* — Waseem Moorad
(74) *Attorney, Agent, or Firm* — Fish & Richardson P.C.

(57) ABSTRACT

System(s) and method(s) are provided for regulation of gamma characteristic of a display having solid-state-based backlight illumination. Regulation of the gamma characteristic can be accomplished at least in part through synchronization of data writing to a set of pixels in a display within a video frame with backlight illumination of a region of the display during a predetermined period, wherein the region is spanned by the set of pixels. Collection of data indicative of illumination intensity of light to be emitted in a region of a backlight source of the display during the predetermined period enables determination of at least one gamma value and at least one gamma reference voltage related to the at least one gamma value. Application of the at least one gamma reference voltage to the set of pixels adjusts the gamma characteristic thereof within the video frame.

21 Claims, 12 Drawing Sheets

REGULATION OF GAMMA CHARACTERISTIC IN A DISPLAY

TECHNICAL FIELD

The subject disclosure relates to displays and, more specifically, yet not exclusively, to control of gamma characteristic of a display having solid-state-based backlight illumination.

BACKGROUND

Backlights are used to illuminate liquid crystal displays (LCDs). LCDs with backlights are used in small displays for mobile phones, personal digital assistants (PDAs), portable computers, as well as in large displays for computer monitors and televisions. Often, the light source for the backlight includes one or more cold cathode fluorescent lamps (CCFLs). The light source for the backlight can also be an incandescent light bulb, an electroluminescent panel (ELP), or one or more hot cathode fluorescent lamps (HCFLs).

As costs of light emitting diodes (LEDs) are reduced and their quality is improved, the display industry is enthusiastically pursuing the use of light emitting diodes (LEDs) as the light source in backlight display technology because CCFLs have many shortcomings: For instance, CCFLs do not easily ignite in cold temperatures, they require adequate idle time to ignite, and they require delicate handling. In addition, LEDs have response times substantially faster than CCFLs. Moreover, the color gamut afforded by LEDs is wider than other light sources employed for backlighting and thus provide more vivid color. Furthermore, LEDs generally have a higher ratio of light generated to power consumed than other backlight sources. Accordingly, displays with LED backlights can consume less power than other displays, which renders LED-based displays more sustainable. LED backlighting has traditionally been used in small, inexpensive LCD panels. However, LED backlighting is becoming more common in large displays such as those installed in computers and television sets. In large LCD displays, several LEDs are generally required to provide adequate backlight for the LCD panel; based on specifics of the display, the number of LEDs can reach several hundreds.

Conventional displays such as those based on cathode ray tubes (CRTs) often have a fixed gamma characteristic which determines luminance of such displays. The gamma characteristic and thus the luminance is predetermined in accordance with a standard and generally suited for images that have been prepared for rendition in CRT-based displays. The gamma characteristic establishes a relationship amongst luminance ($I_{lum}$) of a display and backlight illumination intensity ($I_B$) and magnitude ($V_D$) of a signal related to data (e.g., an image data) to be displayed in the display. Typically, the relationship is a power relationship defined by a gamma value $\gamma$, such that $I_{lum}=\kappa(V_D)^{\gamma}I_B$, where $\kappa$ is an efficiency coefficient independent of $\gamma$. The gamma value $\gamma$ thus defines the gamma characteristic. In an LCD display with LED-based backlighting, several LEDs utilized for backlighting can be partitioned into regions that span a display area of the LCD display. Brightness of at least one of such regions can change dynamically based on content (e.g., data) of an image to be rendered through pixel circuitry in the LCD display. Thus, utilization of a static gamma characteristic generally fails to provide adequate luminance for the LCD display because a static gamma characteristic cannot respond to changes in backlight brightness; low-quality rendered images thus ensues. While typical LCD displays can alter the gamma characteristic of a display on a frame-by-frame basis, such adjustment generally is insufficient for producing rich, compelling imagery.

SUMMARY

The following presents a simplified summary of the subject disclosure in order to provide a basic understanding of some aspects thereof. This summary is not an extensive overview of the various embodiments of the subject disclosure. It is intended to neither identify key or critical elements nor delineate any scope. Its sole purpose is to present some concepts in a simplified form as a prelude to the more detailed description that is presented later.

One or more embodiments of the subject disclosure provide system(s) and method(s) for controlling gamma characteristic of a display having LED-based backlight illumination. Controlling the gamma characteristic of such display can be accomplished at least in part through synchronization of data writing to a set of one or more pixels in a display within a video frame with backlight illumination of a region of the display during a predetermined period, wherein the region is spanned by the set of one or more pixels. Collection of data indicative of illumination intensity of light to be emitted in a region of a backlight source of the display during the predetermined period enables determination of at least one gamma value and at least one gamma reference voltage related to the at least one gamma value. Application of the at least one gamma reference voltage to the set of one or more pixels adjusts the gamma characteristic thereof within the video frame.

To the accomplishment of the foregoing and related ends, the one or more aspects include, without being limited to including, the features hereinafter fully described and particularly pointed out in the claims. The following description and the annexed drawings set forth in detail certain illustrative features of the one or more aspects. These features are indicative, however, of but a few of the various ways in which the principles of various aspects may be employed.

DETAILED DESCRIPTION

Figure 1:
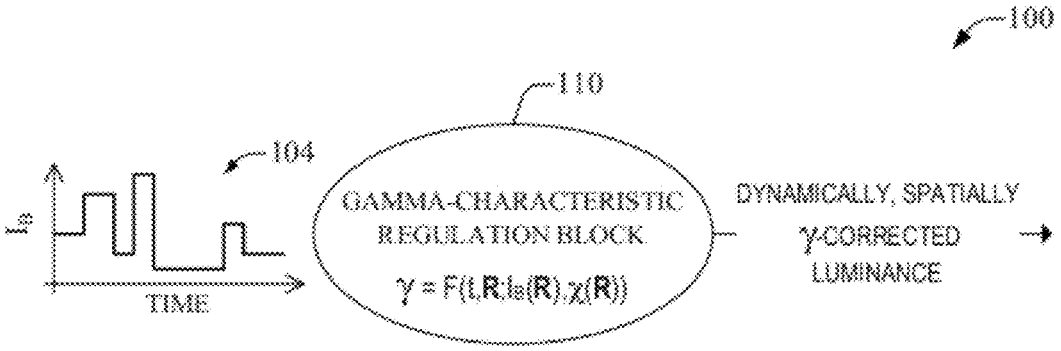
FIG. 1 illustrates an example principle of functionality of regulation of gamma characteristic in a display with solid-state backlighting in accordance with aspects of the subject disclosure.

The subject disclosure is now described with reference to the drawings, wherein like reference numerals are used to refer to like elements throughout. In the following description, for purposes of explanation, numerous specific details are set forth in order to provide a thorough understanding of the present disclosure. It may be evident, however, that the various embodiments of the subject disclosure may be practiced without these specific details. In other instances, well-known structures and devices are shown in block diagram form in order to facilitate describing the present disclosure.

FIG. 1 is a diagram 100 of an illustrative principle of functionality of the subject disclosure. Backlight illumination intensity ($I_B$) signal 104 is acquired (e.g., received) in a gamma-characteristic regulation block 110. In an aspect of the subject disclosure, $I_B$ signal 104 depends on time t, and position R within a display area of a display; the display is an electronic display that is part of a device, is functionally coupled to a device, or is a device itself. The dependence on time and position of $I_B$ is dictated, at least in part, by content of an image that is rendered or to be rendered in the display. In an aspect, a position R within the display represents a discrete region (e.g., a zone or a stripe) of the display area. One or more functional elements (component(s), controller (s), signal generator(s) . . . ) within the gamma-regulation block 110 can adjust a gamma value $\gamma$ based on a predetermined function F(•) of time, position within a display area, and acquired $I_B$; namely, $\gamma=F(t, R; I_B(R))$. The gamma value $\gamma$ also can be adjusted based on a function F'(•) of time, R, $I_B$, and pixel content ($\chi(R)$) of a group of one or more pixels related to the position within the display area; namely, $\gamma=F'(t, R; I_B(R), \chi(R))$. Pixel content refers to data value(s) in at least one pixel in the group, or to a value of a function of the data value(s) in the at least one pixel in the group. Moreover, the gamma value g also can be determined based on a function F"(•) of time, position within the display area, and pixel content; namely $\gamma=F''(t, R; \chi(R))$. Accordingly, in the subject disclosure, luminance of the display is $\gamma$-corrected dynamically, spatially, or dynamically and spatially. Such features of gamma correction enable adjustment of gamma values within a frame rather than on a frame-by-frame basis.

Figure 2:
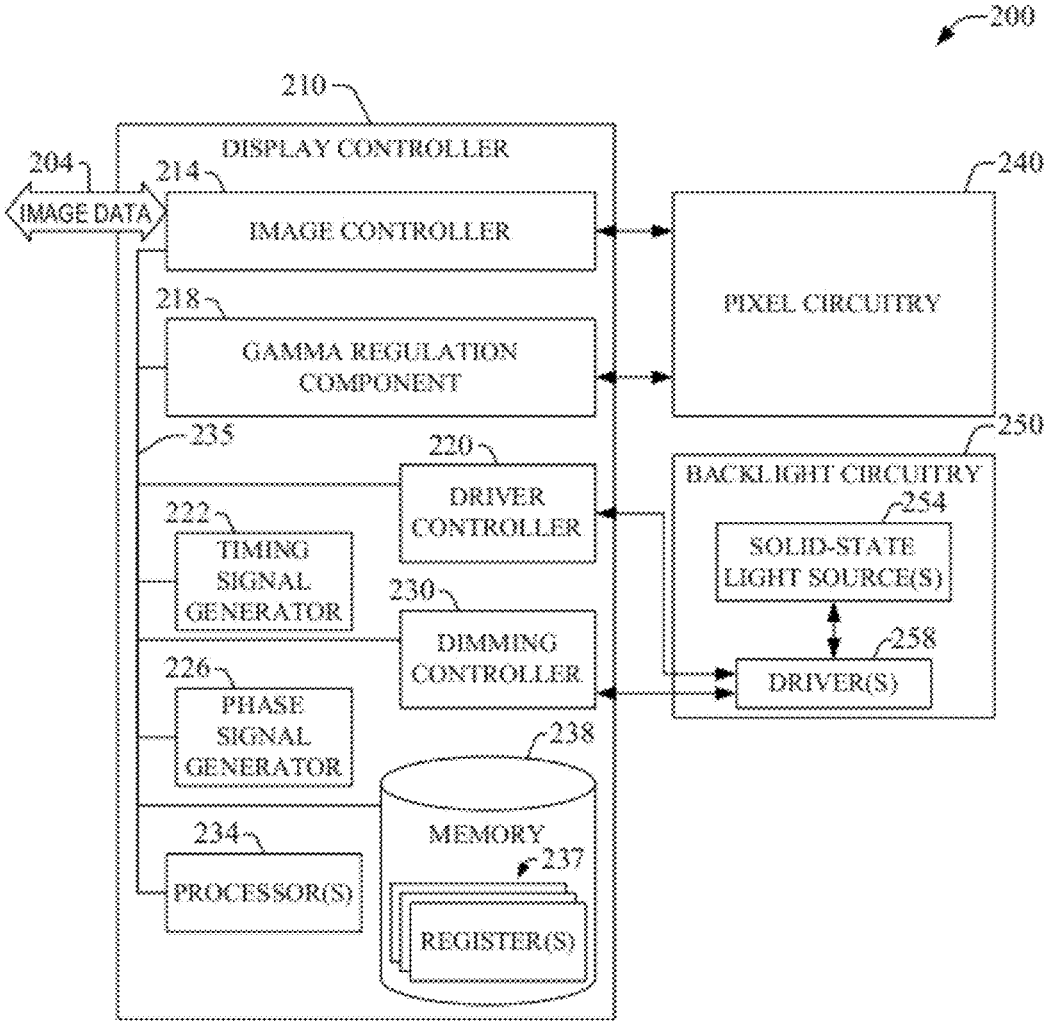
FIG. 2 represents an example display that enables and exploits regulation of gamma characteristic in accordance with aspects described herein.
Figure 3A:
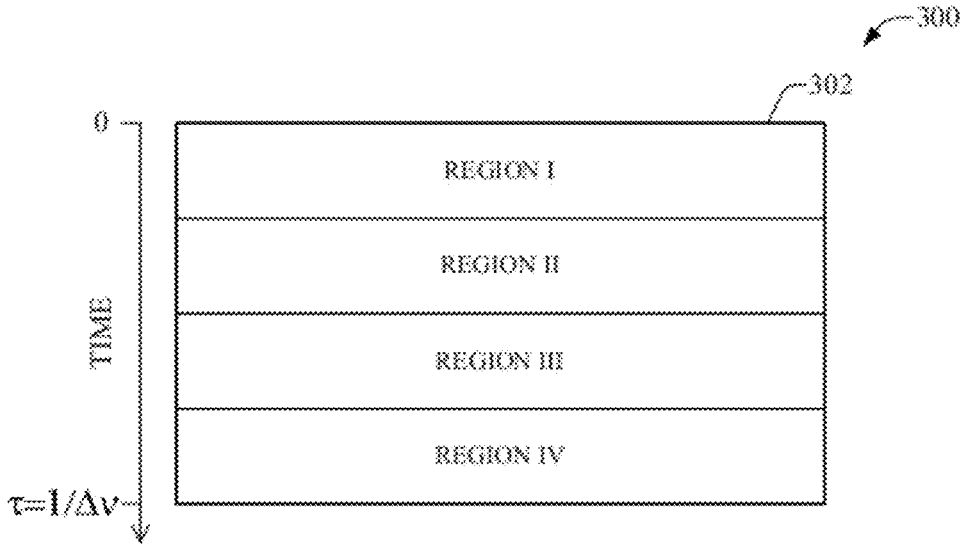
FIGS. 3A-3D represent various example partitions of a display area in accordance with aspects described herein.
Figure 3B:
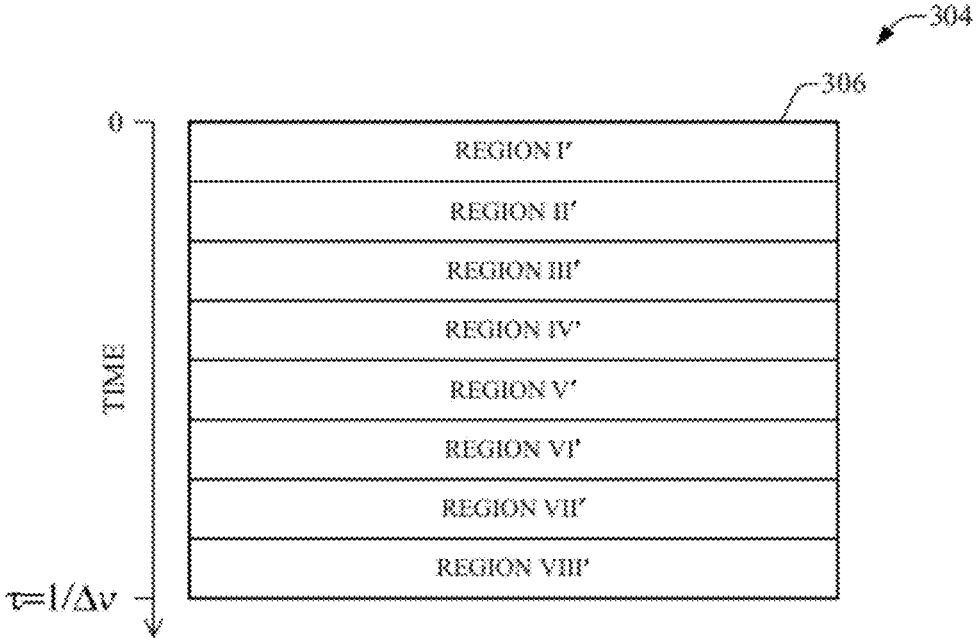
Figure 3C:
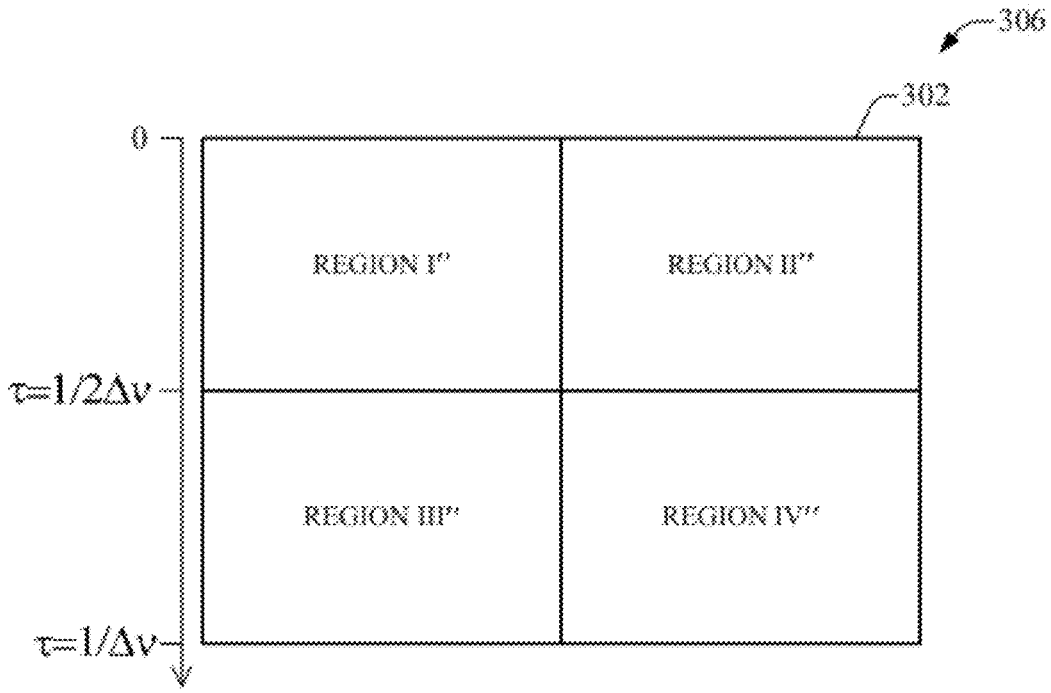
Figure 3D:
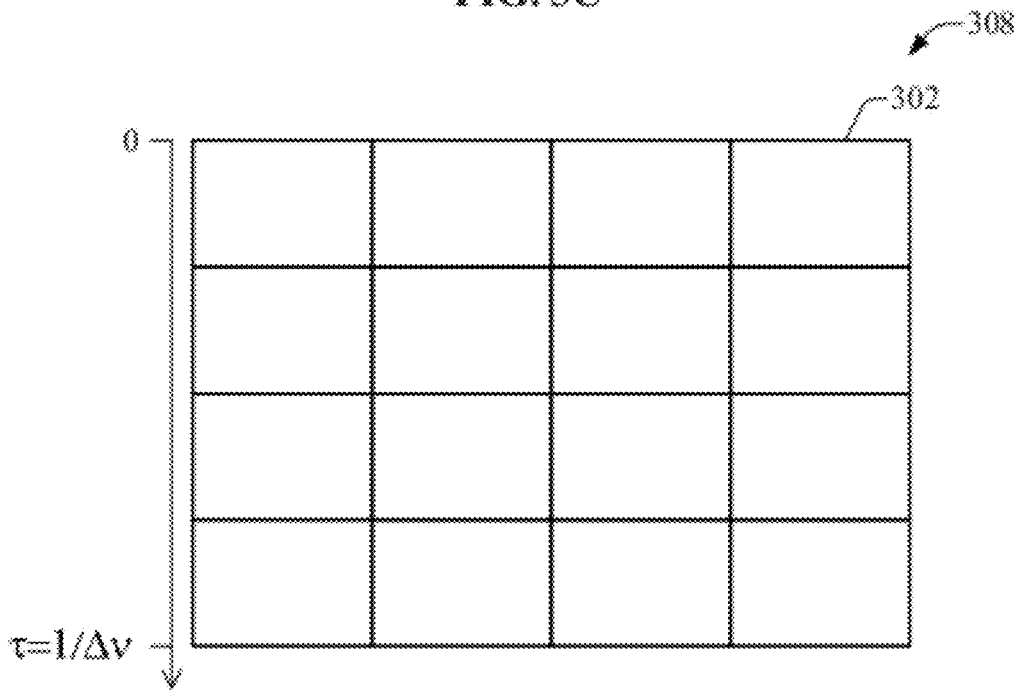

FIG. 2 is a block diagram of an example display 200 that enables and exploits regulation of gamma characteristic, or transfer characteristic, of the subject example display in accordance with aspects described herein. Display controller 210 regulates operation of pixel circuitry 240 and backlight circuitry 250. It should be appreciated that the depicted arrangement of pixel circuitry 240 and backlight circuitry 250 is illustrative and, in electronic displays, at least a portion of pixel circuitry 240 generally lays over at least a portion of backlight circuitry 250. Pixel circuitry 240 includes, but is not limited to including, a set of one or more pixels arranged in a matrix structure spanning K rows and J columns, with K and J positive integer numbers. The area spanned by the set of one or more pixels corresponds to the display area available to example display 200 for rendering images. In embodiments in which each pixel includes a transistor, each row (or line) of pixels shares an electrically common gate node, configured at a common gate voltage; the gate node is part of the transistor within each pixel. Each column of pixels has a common data bus line. In LED-based backlight circuitry, the set of one or more pixels is illuminated by a set of one or more LEDs including, but not limited to including, conventional LED(s), organic LED(s), quantum-dot-based LED(s), and so forth. In typical embodiments, a single LED illuminates several pixels, wherein the single LED can be a white LED, an RGB LED, or an LED emitting at any or substantially any other color (purple, orange, violet, yellow, etc.).

Backlight circuitry 250 illuminates pixel circuitry 240. Backlight circuitry 250 includes solid-state light source(s) 254 and a set of one or more driver(s) 258. As an example, solid-state light source(s) 254 are embodied in a set of one or more LEDs, which can be white LEDs, or LEDs emitting at multiple colors (e.g., red (R), green (G), blue (B) (RGB) LEDs, purple LEDs, orange LEDs . . . ), or a combination thereof. The set of one or more LEDs can be configured as a set of one or more strings of LEDs distributed throughout the display area of example display 200. Typically, each string is coupled to a power supply on one end and to the ground on the other end. One or more strings of LEDs can be associated with a single driver circuit of the set of one or more driver(s) 258. The driver circuit can control application of voltage or supply of current for the one or more strings of LEDs associated with the driver circuit. In certain embodiments, the association of the driver circuit and the one or more strings of LEDs is a one-to-one association. Accordingly, operation (e.g., on/off actuation) of each string can be manipulated independently through the associated driver. For instance, each LED string can be selectively turned on and off for providing localized dimming, or for producing disparate white color of different temperatures. Generally, each string of LEDs includes a group of the LEDs of the same type (e.g., RGB LEDs) to improve uniformity of operational characteristics, such temperature coefficients, I-V characteristics, or the like, and thus enhance control performance of each string of LEDs. LEDs in a string of LEDs of a set of one or more strings of LEDs that can part of backlight circuitry 250 can be discretely scattered across an electronic display and connected in series by wires, traces or other connecting elements. As an example, the LEDs in the set of one or more strings of LEDs can be arranged in vertical fashion or in other arrangements, such as in a horizontal configuration. Moreover, LED strings can be mutually parallel or can be deployed in other relative orientations.

Through disparate organization the set of one or more strings of LEDs, a backlighting area can be partitioned into various zones, as illustrated in FIGS. 3A-3D. Diagram 300 illustrates a partition in P=4 zones, each including n=K/4 pixel lines, wherein K (e.g., 1080) is the total number of pixel lines in the display. The illustrated display 302 has a refresh frequency $\Delta v$, which leads to a frame period $\tau=\Delta v^{-1}$. In an example, for $\Delta v=240$ Hz, $\tau\cong4.167$ ms. Similarly, diagram 304 illustrates a partition in eight zones, which results in regulation of backlight illumination of a smaller number of pixels. In such scenarios, backlight unit, e.g., set of one or more LED strings, is turned on after all pixels or substantially all pixels in a zone (e.g., Region I) are settled.

Diagrams 306 and 308 present partitions in four and 16 tiles, respectively. In particular, though not exclusively, phase delays and duty cycles for backlight illumination can vary from tile to tile. Moreover, gamma regulation component 218 can be functionally coupled to a set of one or more driver circuits that enable to configure disparate subsets of pixel columns in the K×J pixel matrix structure. In certain embodiments, the set of one or more drivers can be part of image controller 214. In additional or alternative embodiments, such set of one or more drivers can be included in gamma regulation component 218. In an aspect, the larger the number P of zones in which the display area is divided, the higher the efficiency of the display with respect to duty cycle of the backlight unit (e.g., a set of one or more LED strings and associated driver(s)) in the display.

Figure 4:
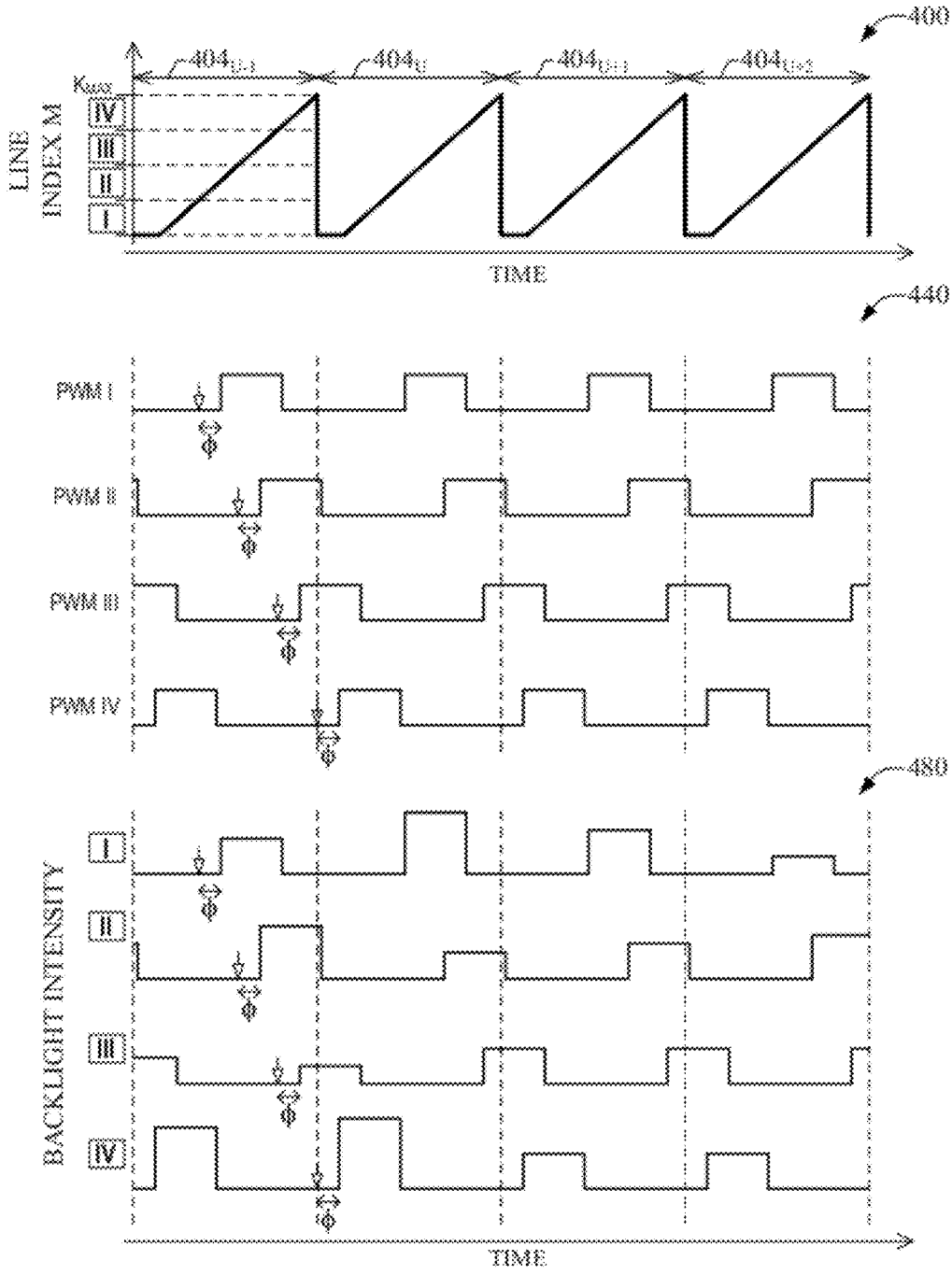
FIG. 4 illustrates line-by-line writing of data into a display and related backlighting features in accordance with aspects described herein.

As part of regulation of operation of pixel circuitry 240, image controller 214 receives data, e.g., image data 204, and supplies the data to the pixel circuitry 240. To supply the data, image controller 214 can write the data into each pixel in a line-by-line manner, or scrolling motion; data is written in a pixel by charging the capacitor that is part of the pixel. Image controller 214 can include at least one digital-to-analog converter (DAC) to charge the capacitor based at least on the data intended to or available for the pixel. Diagram 400 in FIG. 4 presents a sketch of the line-by-line data writing in a group of K×J pixels that is partitioned into four stripe zones, Regions I-IV (see FIG. 3A), labeled "I", "II", "III", and "IV". Each pixel line is identified by line index M (a natural number) that, in certain embodiments, equals 1080. Four arbitrary video frames $\mathbf{404}_{U-1}$, $\mathbf{404}_{U}$, $\mathbf{404}_{U+1}$, and $\mathbf{404}_{U+2}$ are depicted, with U a natural number equal to or greater than unity.

In an aspect, to scan the group of K×J pixels that can be part of pixel circuitry 240, and write data to such pixels on a line-by-line basis, image controller 214 can exploit timing signal generator 222. Timing signal generator 222 can produce clock signals that enable image controller 214 to scan the group of K×J pixels. The clock signals can include vertical synchronization (VSYNC) signal, horizontal synchronization (HSYNC) signal, gate shift clock (GSC) signal, and so forth. Timing signal generator 112 also can multiply the frequency of the clock signals to generate timing signals with higher frequency. Through multiplication of the frequency of at least one of the clock signals, the timing signal generator 112 can produce a timing signal that defines a sub-frame period for scanning a group of pixels that is part of a line of pixels in pixel circuitry 240. Moreover, timing signal generator 112 can scale (or divide) the amplitude of one or more of the clock signals.

Additionally, in order to mitigate blur artifacts due to rapidly changing image(s) and improve motion picture response, display controller 210 can illuminate pixel circuitry 240 in a lagging scrolling motion fashion through backlight circuitry 250. Diagram 440 in FIG. 4 represents a phase-shifted pulse-width modulation (PWM) dimming that can be associated with groups of LEDs respectively associated with Regions I-IV. To at least that end, display controller 210 can exploit the clock signal generated by timing signal generator 222, and that enables scanning of the group of K×J pixels, to recognize an instant $\tau_1$ (open-head arrow in diagram 440) at which a first zone (e.g., Region I) of the pixel matrix structure of pixel circuitry 240 has been written completely. Display controller 210 can accomplish such identification by generation of a counter through addition of a count unit per written line of pixels and comparison with a predetermined number of lines assigned to the first zone. In response to recognizing the instant $\tau_1$, triggers a disparate counter that enables to introduce a delay or phase $\phi$; upon or after a time equal or substantially equal to the phase $\phi$ has elapsed, a driver controller 220 in display controller 210, energizes (e.g., powers on) a group of LEDs within backlight circuitry 250 associated with the first zone to emit light at a first intensity based at least in part on data written to the first zone. To improve efficiency, the driver controller 220 exploits dimming controller 230 to effect illumination of the first zone through pulse-width modulation (PWM) dimming of power supplied thereto. In an aspect, the group of LEDs forms a string of LEDs and dimming controller 230 selectively turns on and off the string of LEDs according to a time waveform, or profile, specific to such string. The time waveform embodies the PWM modulation of power supplied to such string of LEDs; the time waveform has a predetermined frequency (f) and a single predetermined duty cycle (D). Timing signal generator 222 provides clock signals that determine the PWM dimming waveform and therefore the predetermined frequency f. Phase signal generator 226 can produce one or more values of phase $\phi$; one or more phase delay register(s) can be part of a memory within the dimming controller 230 or functionally coupled thereto. In certain scenarios, the frequency f is the frame frequency established by timing signal generator 222 to scan the group of the K×J pixels. As further lines of pixels in pixel circuitry 240 are written, related zones (e.g., Regions II-IV) are completely written. For each zone that is written completely, driver controller triggers a counter to enable a delay or phase $\phi$. As described above, upon or after the phase $\phi$ elapses, the driver controller 220 can energize (e.g., power on) a group of LEDs associated with the zone that has been written completely. Moreover, each of such zones is configured to emit light at respective intensities that are based at least in part on the data written to each zone. In addition, dimming controller 230 enables each of such zones to be illuminated in accordance with a PWM power waveform with frequency f and duty cycle D, but phase-shifted by $\phi$ with respect to a previously illuminated zone.

As described previously and illustrated in diagram 480 in FIG. 4, each zone (e.g., Regions I-IV) are illuminated with disparate backlight intensity in response to each of such zones being written in their entireties within a video frame 404. In example display 200, within a video frame U (a natural number) and for each Region $\rho$, with $\rho$=I, II, III, or IV, a gamma regulation component 218 adjusts (e.g., increases, decreases, or preserves) a gamma value based on illumination intensity of light emitted from Region $\rho$; the gamma value is adjusted from gamma value for a previous video frame U' (with U'<U).

To adjust a gamma value within a video frame (e.g., $\mathbf{404}_{U}$), the gamma regulation component 218 can apply a reference voltage ($V_{Ref}$) to a driver circuit that generates the reference voltage in the transistor present in a pixel. For a pixel that has a Red sub-pixel, a Green sub-pixel, and a Blue sub-pixels, a gamma reference voltage $V_{Ref}^{(Red)}(\gamma)$, a gamma reference voltage $V_{Ref}^{(Green)}(\gamma)$, and a gamma reference voltage $V_{Ref}^{(Blue)}(\gamma)$ are applied to the pixel, respectively. In general, for a pixel that includes a set of one or more colored LEDs emitting respectively at colors $v_1, v_2, v_3 \ldots v_s$, a set of one or more gamma reference voltages for each color—$V_{Ref}^{(v_2)}(\gamma)$, $V_{Ref}^{(v_2)}(\gamma)$, $V_{Ref}^{(v_3)}(\gamma) \ldots V_{Ref}^{(v_S)}(\gamma)$—are applied to the pixel. Here C is a natural number equal to or greater than unity (1). It should be appreciated that red, green, and blue can be included in the set of one or more S colors $v_1, v_2, v_3 \ldots v_S$.

In an aspect, gamma regulation component 218 establishes (computes, receives, retrieves, etc.) a gamma value $\gamma$ based on a function $F(t, R; I_B(R))$ and acquires (receives, retrieves, etc.) at least one gamma reference voltage (e.g., $V_{Ref}^{v_1)}(\gamma)$, $V_{Ref}^{v_2)}(\gamma)$, $V_{Ref}^{v_3)}(\gamma) \ldots V_{Ref}^{v_B)}(\gamma)$) associated with the established gamma value $\gamma$. Such association can be a many-to-one relationship, for example, in order to discretize a continuum of values provided by a continuous function $F(t, R; I_B(R))$ into a discrete set of one or more gamma values $\{\gamma_1, \gamma_2, \gamma_3 \ldots \gamma_G\}$, with G a predetermined natural number. The gamma regulation component 218 applies the at least one gamma reference voltage (e.g., $V_{Ref}^{\nu 1)}(\gamma)$, $V_{Ref}^{\nu 2)}(\gamma)$, $V_{Ref}^{\nu 3)}(\gamma) \ldots V_{Ref}^{\nu B)}(\gamma)$ to each pixel in a region ρ illuminated with intensity $I_B(\rho)$. To mitigate image disturbance, gamma regulation component 218 can apply a gamma reference voltage during the horizontal blanking period (not shown in diagram 400), dictated by reciprocal of HSYNC frequency, in response to completion of data delivery to a region (see, e.g., FIGS. 3A-3D) in the display area.

Figure 5:
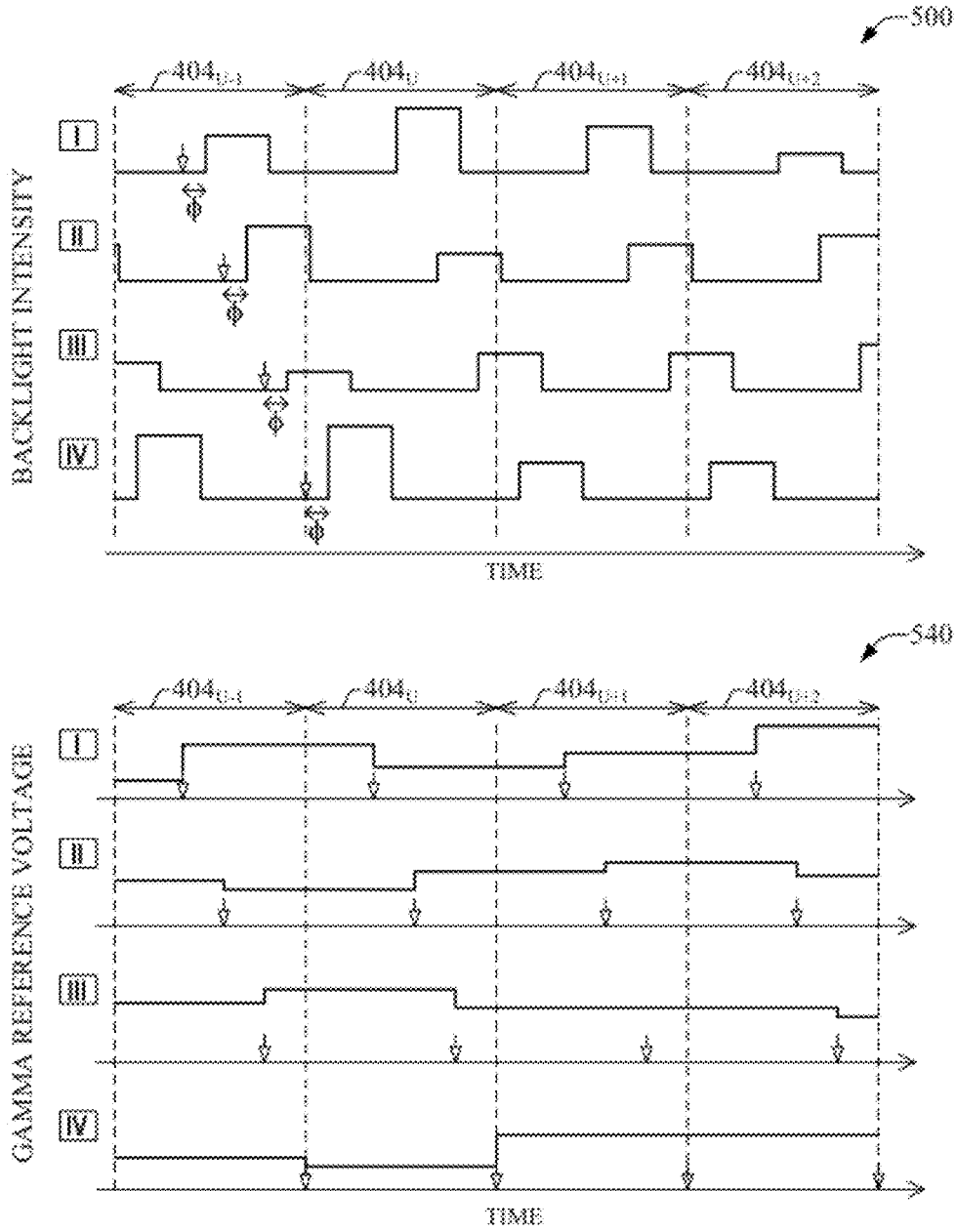
FIG. 5 illustrates time-dependent and space-dependent example profiles of backlight illumination intensity and related example profile of gamma reference voltages associated with gamma values pertinent to the example profile of backlight illumination intensity in accordance with aspects described in the subject disclosure.
Figure 6:
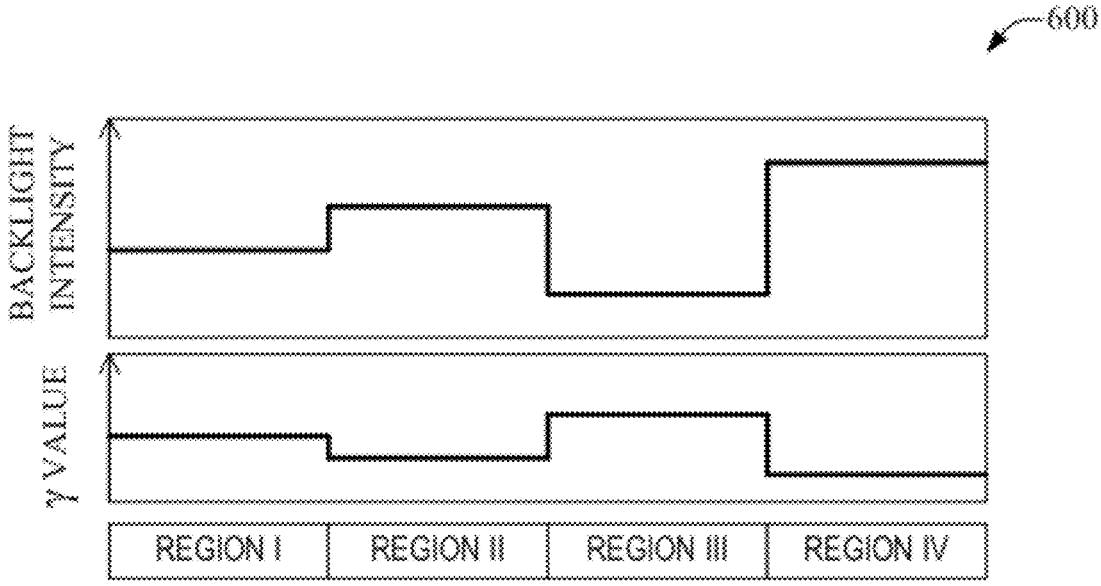
FIG. 6 represents the spatial dependence of gamma values associated with backlight illumination intensities for a selected frame in FIG. 5.

Diagram 500 in FIG. 5 illustrates a time-dependent (frame-to-frame) and space-dependent (region-to-region) example profile, or example waveform, of backlight illumination intensity. In turn, diagram 540 presents an example profile of gamma reference voltages associated with gamma values that correspond to the backlight illumination intensities of diagram 500. To illustrate spatial dependence of gamma values within a frame, diagram 600 in FIG. 6 illustrates gamma values for video frame $\mathbf{404}_{U-1}$ based at least on backlight illumination intensity (see diagram 500). Accordingly, display controller 210 enables example display 200 to adjust the gamma characteristic thereof for the various regions in which a display area associated with example display 200 is partitioned. Similar diagrams are obtained for other video frames.

Figure 7:
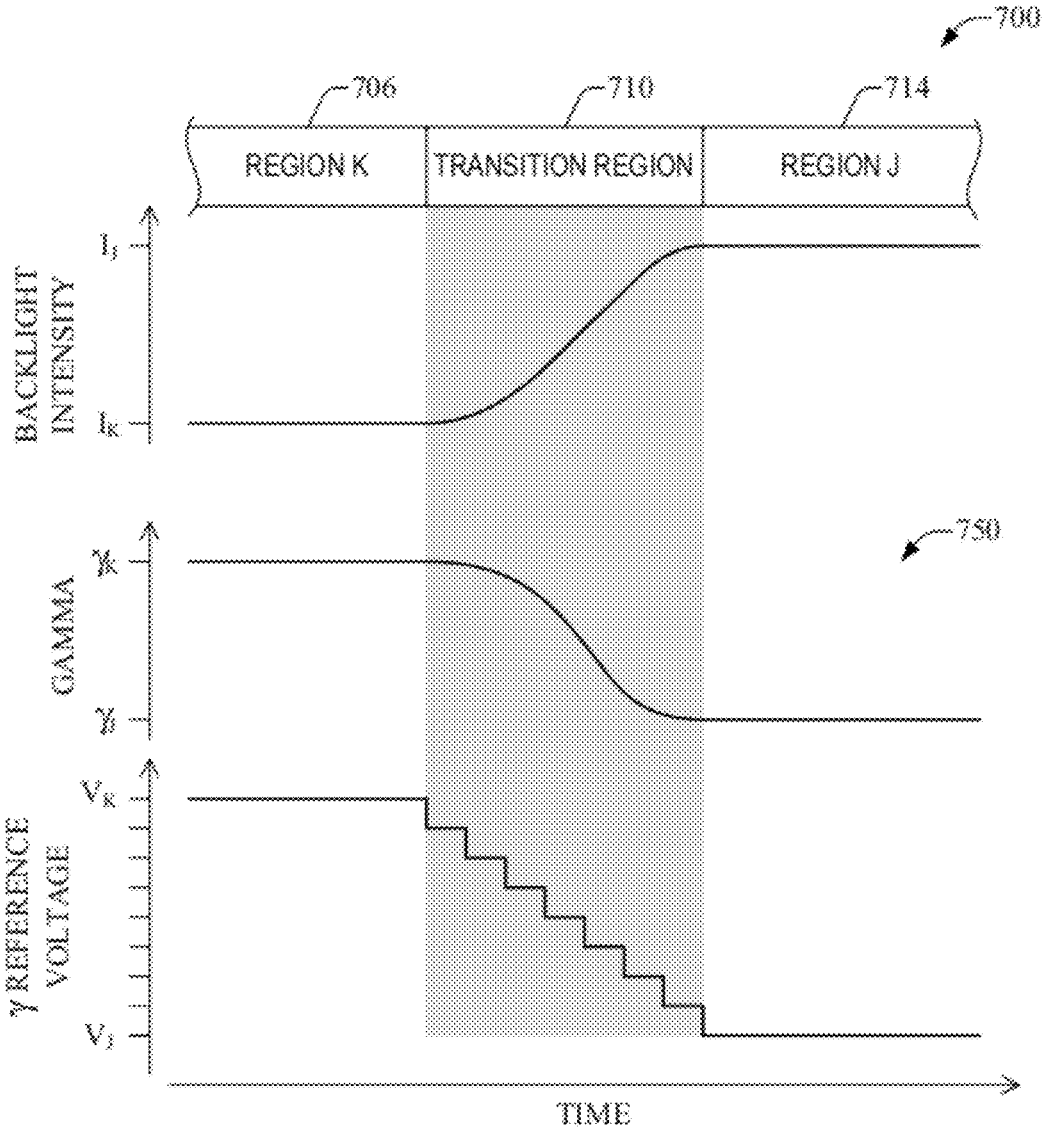
FIG. 7 depicts spatial dependence of backlight illumination intensity and related gamma values amongst adjacent regions in a display area of a display in accordance with aspects described herein.

It should be appreciated that illumination intensity at a region boundary is not abrupt due to overlap at region edges of adjacent regions. Such overlap is a result of the smaller density of solid-state light source elements (e.g., strings of LEDs) in backlight circuitry 250 with respect to density of pixels in pixel circuitry 240. Accordingly, a transition region that spans one or more pixel lines generally is present amongst two adjacent regions; in the transition region, a first backlight illumination intensity in a first region gradually transitions, or fades, to a second backlight illumination intensity in a second region. Specific number of pixel lines in such transition region is dictated, at least in part, by the topology, or physical arrangement, of the solid-state light source elements (e.g., strings of LEDs) in backlight circuitry 250. Diagram 700 in FIG. 7 depicts such backlight illumination intensity transition from backlight brightness $I_K$ in Region K 706 to backlight brightness $I_J$ in Region J 714. The transition spans a transition region 710 in which backlight brightness presents backlight brightness values amongst a first value $I_K$ and a second value $I_J$. In accordance with aspects of the subject disclosure, and as illustrated in diagram 750, a first gamma value $\gamma_K$ for Region K 706 also transitions to a second gamma value $\gamma_J$ for Region J 714. As gamma values determine, at least in part, luminance of a display, gradual transition as opposed to abrupt transition from the first gamma value $\gamma_K$ to the second gamma value $\gamma_J$ can reduce visibility or perception by an end-user of the display of the change in luminance from Region K to Region J.

In an aspect, gamma values $\gamma_K$ and $\gamma_J$ are associated, respectively, with gamma reference voltages $V_K$ and $V_J$. In diagram 750, $Q_0$=7 gamma values span the transition region 710, such values can correspond to $Q_0$=7 pixel lines present in the transition region 710. It should be readily appreciated that the transition region 710 can span Q pixel lines, with Q a natural number greater than or equal to unity (1), and Q intermediate gamma reference voltages $\{V_1, V_2 \ldots V_{Q-1}, V_Q\}$ associated with intermediate gamma values can be implemented. In an aspect, configuration of such gamma reference voltages is effected on a line-by-line basis. To at least that end, in an example embodiment, gamma regulation component 218 can configure an intermediate gamma value (e.g., apply an intermediate gamma reference voltage) during a horizontal blanking period configured for example display 200 (or any display that includes the gamma regulation component 218). Configuration of a gamma value during such blanking interval mitigates or completely avoids image disturbances that can arise from driving the transistor associated with the line of pixel(s) in a transition region. As part of configuration of the intermediate gamma reference voltages, gamma regulation component 218 can access a memory included therein or functionally coupled thereto, wherein the memory has stored, or programmed, thereon the Q intermediate gamma reference voltages $\{V_1, V_2 \ldots V_{Q-1}, V_Q\}$, with Q a natural number.

In certain embodiments gamma regulation component 218 also can adjust gamma values in alternative partitions of a display area (see, e.g., FIGS. 5B-5D) of a display with solid-state-based backlight illumination. For example, gamma regulation component 218 can control gamma values, or related gamma reference voltages, for a partition of the K×J pixels into a set of one or more E tiles, with each tile including, but limited to including, (K/E)×(J/E) pixels. In an aspect, gamma regulation component 218 can include a group of column drivers that configure gamma reference voltages for respective subsets of columns in the set of one or more E tiles, with E a natural number greater than or equal to unity (1).

Figure 8:
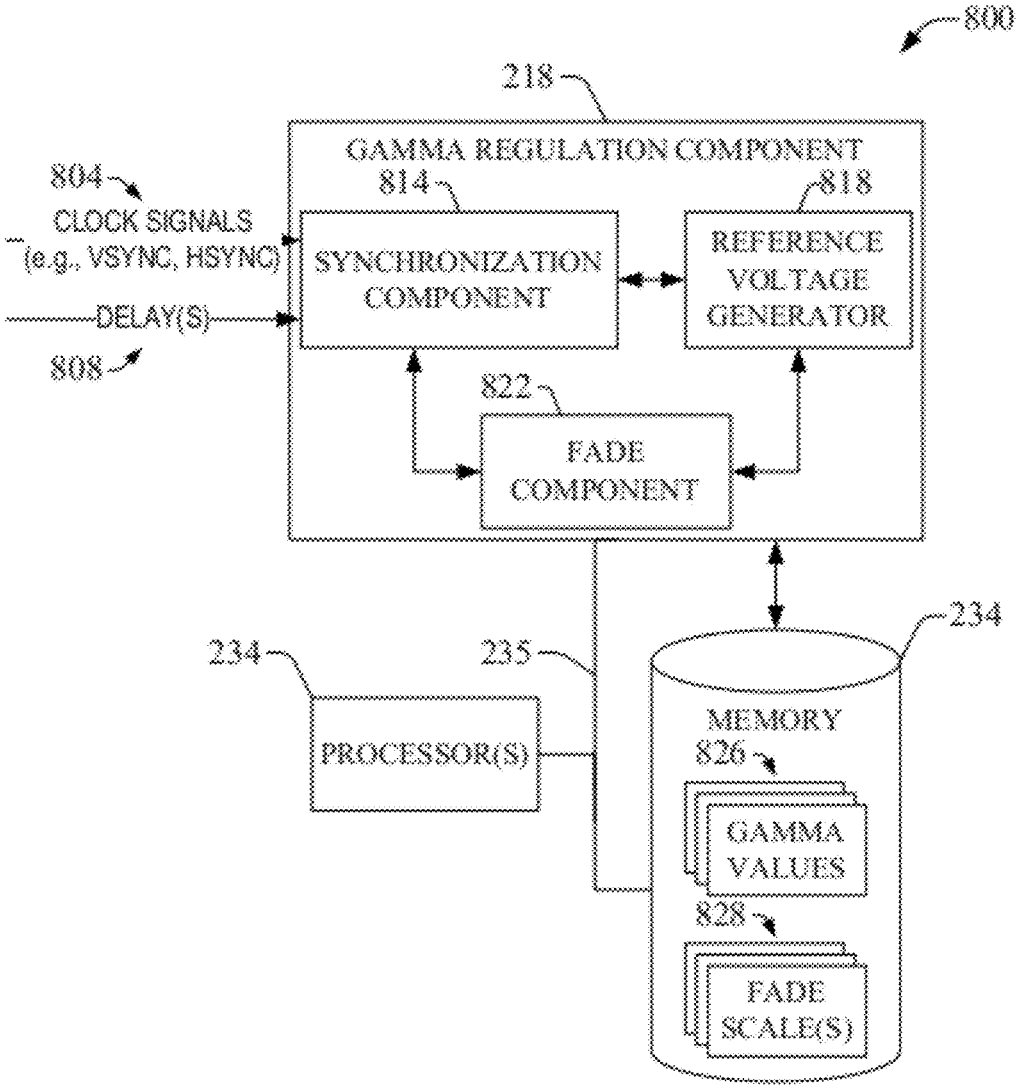
FIG. 8 illustrates an example embodiment of a gamma regulation component that enables various features in connection with control of gamma characteristic of a display in accordance with aspects described herein.

FIG. 8 illustrates an example embodiment 800 of a gamma regulation component 218 that enables various features in connection with control of gamma characteristic of a display in accordance with aspects described herein. Synchronization (sync) component 814 acquires (receives, retrieves, etc.) clock signal(s) 804 and a set of one or more delays (or phases). Timing signal generator 222 can produce the clock signal(s) 804 and phase signal generator 226 can produce the set of one or more delays 808. In response to acquisition of at least one clock signal related to writing data to pixel circuitry 240, sync component 814 initiates a first counter that accounts for a current number of pixel lines that have been written; as described previously, image controller 214 writes the data. Upon or after the first counter reaches a value equal to the number of pixel lines in a first region of a display area associated with example display 200, sync component 814 (i) resets the first counter, or timer, and initiates a second counter, or timer, linked to horizontal write blanking (e.g., HSYNC) of the display; and (ii) signals reference voltage generator 818 to issue at least one gamma voltage reference value. In certain scenarios, such as in digital implementations, sync component 814 can signal reference voltage generator 818 by delivering a multi-bit word. In alternative or additional scenarios, such as in analog implementations, sync component 814 can signal reference voltage generator 818 by energizing a pin that functionally couples sync component 814 to reference voltage generator 818.

In response to signaling and related payload data received from sync component 814, reference voltage generator 818 can collect a group of gamma value(s) from the set 826 of one or more gamma values and configure a group of gamma reference voltage(s). Reference voltage generator 818 can apply the group of gamma reference voltage(s) to the group of pixels in the first region. In aspect, the set 826 of one or more gamma values can be part of the one or more register(s) 237. The group of gamma reference voltage(s) is applied before or upon the second counter reaches a threshold counts that convey that HSYNC interval has elapsed. In a scenario in which white LEDs embody the solid-state light source(s) 254, the group of gamma reference voltage(s) has at least one gamma reference voltage $V_{Ref}(\gamma)$. In an alternative scenario in which RGB LEDs embody the solid-state light source(s) 254, the group of gamma reference voltage(s) has at least three gamma reference voltages: $V_{Ref}^{(Red)}(\gamma_r)$, $V_{Ref}^{(Green)}(\gamma_G)$, and $V_{Ref}^{(Blue)}(\gamma_B)$. In another alternative scenario, when a set of one or more LEDs of multiple colors $v_1, v_2, v_3 \ldots v_C$ embodies the solid-state light source(s) 254, the group of gamma reference voltage(s) has at least C gamma reference voltages values $V_{Ref}^{(v_1)}(\gamma_{v_1}), V_{Ref}^{(v_2)}(\gamma_{v_2}), V_{Ref}^{(v_3)}(\gamma_{v_3}) \ldots V_{Ref}^{(v_C)}(\gamma_{v_C})$, where C is a natural number equal to or greater than unity (1).

As discussed above, gamma regulation component 218 can enable "fading", or gradual transition, of gamma values amongst two gamma values associated with respective two adjacent regions (e.g., Region I and Region II, or Region V' and Region VI') of a display area. In an aspect, to implement such "fading", gamma regulation component 218 can include a fade component 822 that is configured (e.g., programmed) with an offset value $\delta=2\times n_\Delta+1$ that represents a number of pixel lines spanned by a transition region (e.g., as illustrated by transition region 710) that separates two adjacent regions (e.g., Region K 706 and Region J 714). In addition, fade component 822 also receives timing signal(s) for a counter $n_L$, from sync component 814 and initiates a transition counter $n_T$ upon or substantially at a time after the last line $n_L=W-n_\Delta-1$ of a first region has been written; W is a natural number. Counter $n_L$, continues to accrue counts as a result of data being written to lines of pixels in the transition zone. Counter $n_L$, is synchronized with counter $n_T$; however, at each increment of counter $n_T$ by 1, e.g., after a line of pixels in the transition zone is written completely, reference voltage generator 818 extracts a fade gamma value determined by at least one fade scale in the set 828 of one or more fade scale(s) and configures a fade gamma reference voltage that corresponds to the fade gamma value. In aspect, the set 828 of one or more fade scale(s) can be part of the one or more register(s) 237. As indicated previously, a set of Q fade gamma reference voltage values $\{V_1, V_2 \ldots V_{Q-1}, V_Q\}$ can be retained in the set 828 of one or more fade scale(s). As an alternative, a single voltage offset $\Delta V$ can be retained in memory 238 in conjunction with a logical variable that indicates that fade gamma reference values can be generated through the recursion $V_{\omega+1}-V_\omega=\Delta V$, with $\omega=1, 2, \ldots, Q$, and $\Delta V=\gamma_K-\gamma_J$. As described above, reference voltage generator 818 applies the fade gamma reference voltage during the horizontal write blanking period (HSYNC) of the display that includes gamma regulation component 218. Accordingly, in an aspect, gamma regulation component 218 adjusts the gamma characteristic of the transition region (e.g., 710) on a line-by-line basis.

In example display 200, to implement the various features or aspects described in the foregoing passages, display controller 210 can include one or more processor(s) 234. In addition, input/output (I/O) component(s) (not shown) can enable configuration of various registers and other values utilized in operation of display controller 210. In an aspect, the one or more processor(s) 234 can enable or be configured to enable, at least in part, the described functionality of display controller 210 or one or more functional elements (e.g., component(s), generator(s), block(s), module(s)) therein. In an aspect, to provide such functionality, the one or more processor(s) 234 can exploit a bus architecture 235 to exchange data or any other information amongst functional elements (e.g., component(s), controller(s), generator(s), blocks) within display controller 210 and a memory 238 functionally coupled thereto. The bus architecture 235 can be embodied in at least one of a memory bus, a system bus, an address bus, a message bus, a set of one or more pins, or any other conduit, protocol, or mechanism for data or information exchange among components that execute a process or are part of execution of a process. The exchanged information can include at least one of code instructions, code structure (s), data structures, or the like.

The one or more processor(s) 234 also can execute computer-executable instructions (not shown) stored in memory 238 to implement (e.g., execute) or provide at least part of the described functionality of display controller 210. Such code instructions can include program modules, software applications, or firmware applications that implement specific tasks which can be accomplished, for example, through one or more of the methods disclosed herein and that are associated, at least in part, with functionality or operation of example display 200. In one or more alternative or additional embodiment(s), the one or more processor(s) 234 can be distributed amongst one or more functional elements (components, blocks, etc.) of display controller 210.

In one or more embodiments, display controller 210 can be either a general microcomputer or a special purpose microcomputer. Display controller 210 and other component(s) or functional element(s) can be implemented on a single integrated circuit (IC) chip or on multiple IC chips. ICs can include at least one processor, which can be part of processor (s) 234. In embodiments including multiple IC chips, functional elements of display controller 210 can be arranged in modules, wherein in each module is implemented in an IC. In addition, through provision of computer-executable instructions to a memory functionally coupled to the display controller 210 or included therein, display controller 210 can be programmable. In the alternative, display controller 210 can be non-programmable and operate in accordance with aspects herein as established at manufacturing time. In a combined approach, certain features of display controller 210 can be programmable while others can be non-programmable and preserved as provisioned at manufacturing time. Display controller 210 or one or more components therein can be implemented in hardware, software, or firmware.

Figure 9:
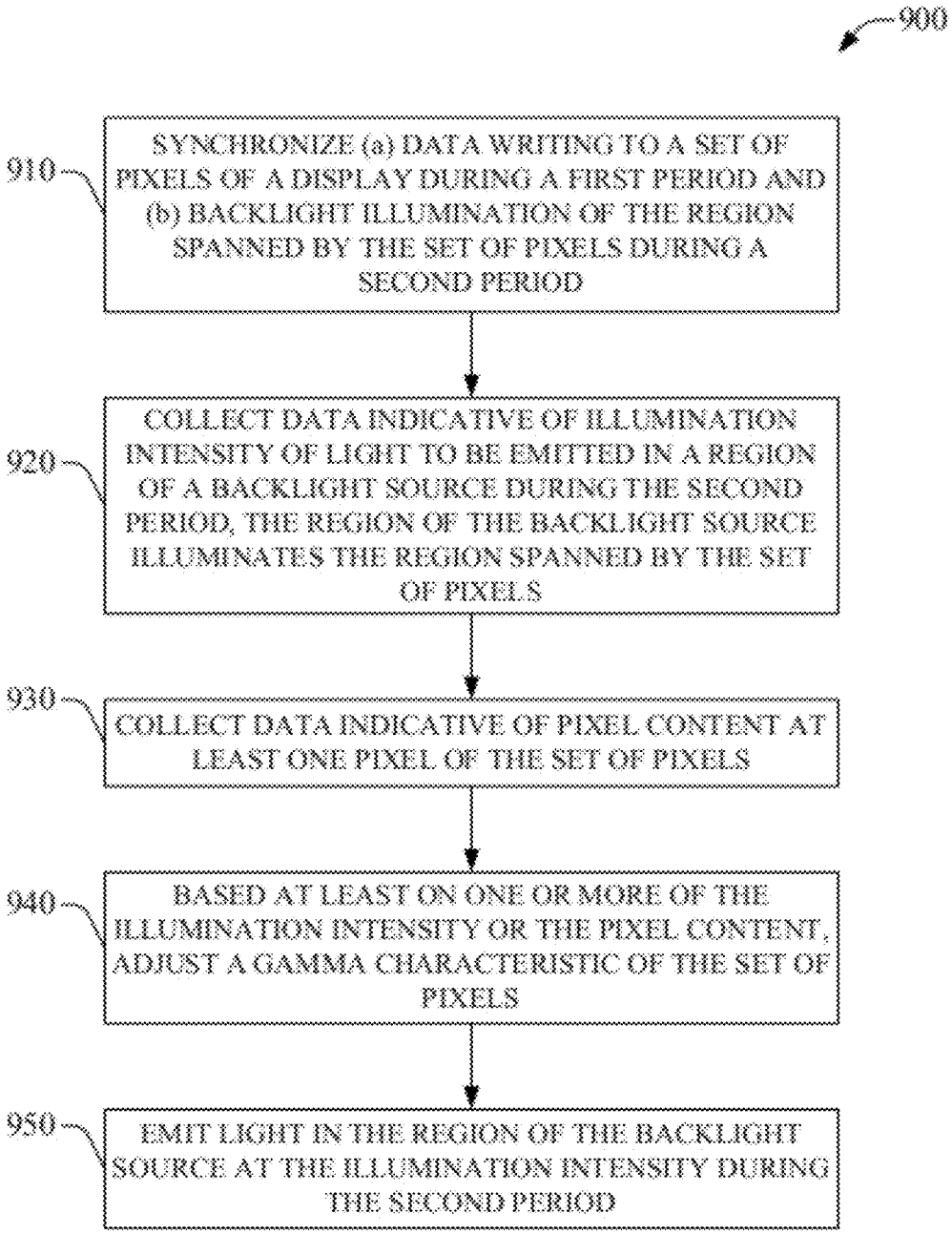
FIG. 9 presents an example method for regulating gamma characteristic of a display having solid-state-based backlight illumination in accordance with aspects described herein.
Figure 10:
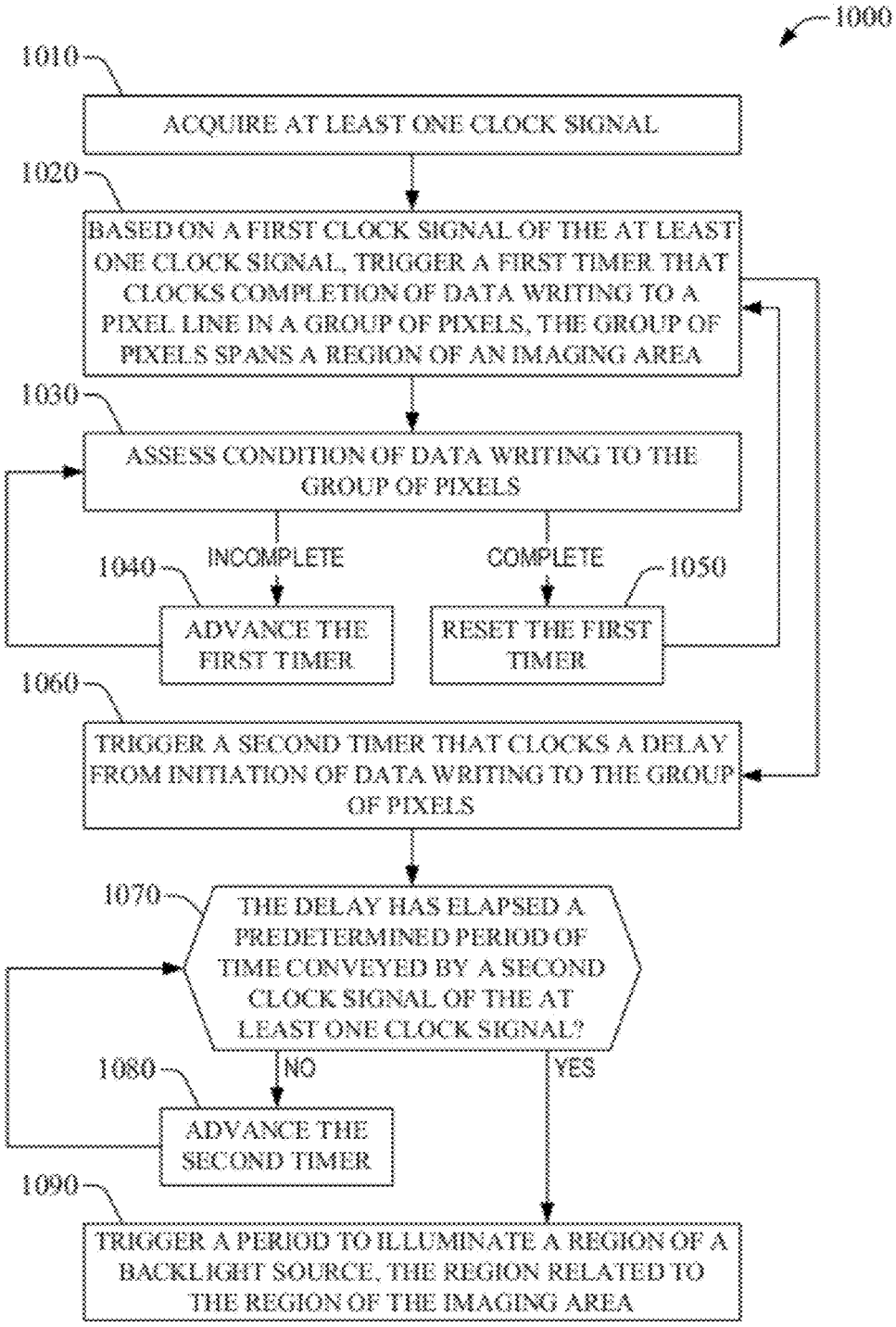
FIG. 10 depicts an example method for synchronizing data writing to a region in an imaging area and backlight illumination in a region of a backlight source according to aspects described herein.
Figure 11:
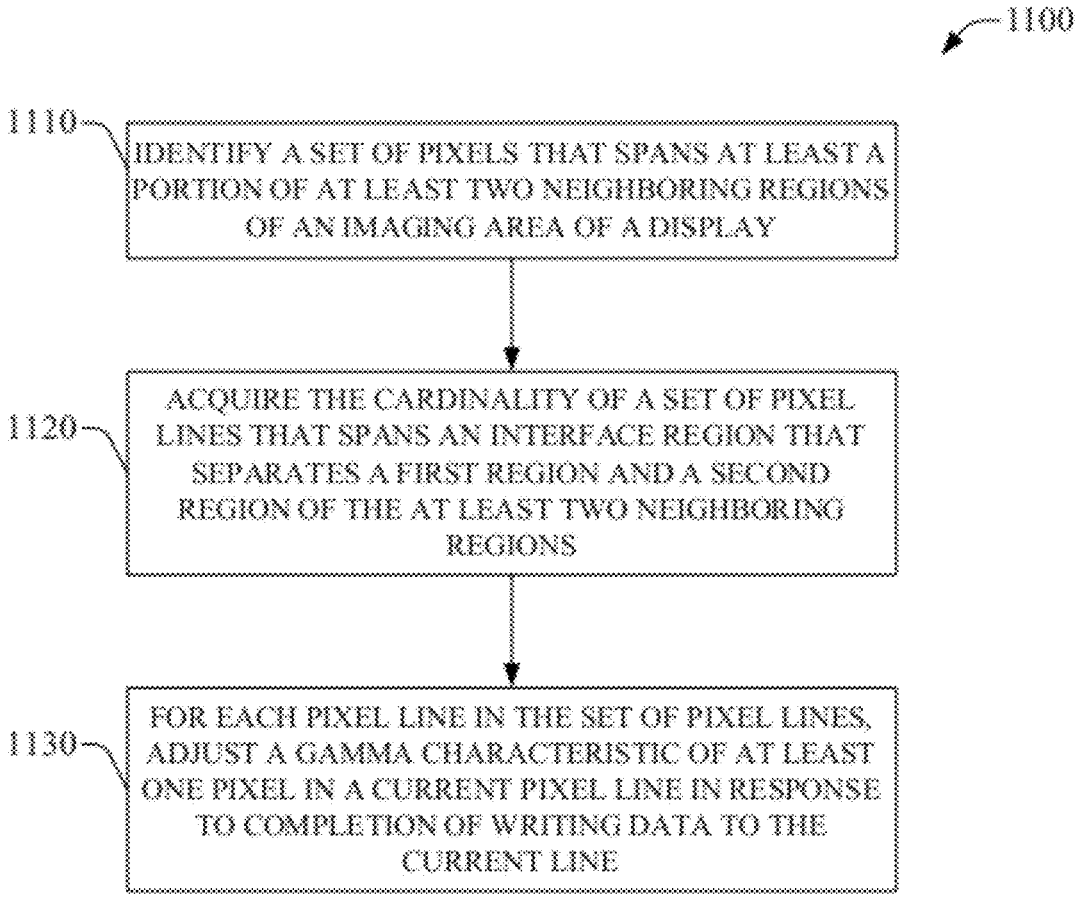
FIG. 11 presents an example method for fading luminance characteristics of disparate display areas in a display according to aspects of the subject disclosure.

In view of the example system(s) described above, example methods that can be implemented in accordance with the disclosed subject matter can be better appreciated with reference to flowchart in FIGS. 9-11. For purposes of simplicity of explanation, example methods disclosed herein are presented and described as a series of acts; however, it is to be understood and appreciated that the disclosed subject matter is not limited by the order of acts, as some acts may occur in different orders and/or concurrently with other acts from that shown and described herein. For example, one or more example methods disclosed herein can alternatively be represented as a series of interrelated states or events, such as in a state diagram. Moreover, interaction diagram(s) may represent methods in accordance with the disclosed subject matter when disparate entities enact disparate portions of the methodologies. Furthermore, not all illustrated acts may be required to implement a described example method in accordance with the subject specification. Further yet, two or more of the disclosed example methods can be implemented in combination with each other, to accomplish one or more features or advantages described herein.

Method(s) disclosed throughout the subject specification and annexed drawings are capable of being stored on an article of manufacture to facilitate transporting and transferring such method(s) to computers or chipsets, e.g., integrated semiconductor-based circuits, with processing capability (ies) for execution, and thus implementation, by a processor, or for storage in a memory. In an aspect, one or more processors that enact method(s) described herein can be employed to execute code instructions retained in a memory, or any computer- or machine-readable storage medium, to implement method(s) described herein; the code instructions, when executed by the one or more processor implement or carry out the various acts in the method(s) described herein. The machine-executable or computer-executable instructions provide a machine-executable or computer-executable framework to enact (e.g., execute) the method(s) described herein.

FIG. 9 is a flowchart of an example method 900 for regulating gamma characteristic of a display having LED-based backlight illumination in accordance with aspects described herein. At act 910, data writing to a set of one or more pixels of a display during a first period is synchronized with backlight illumination, during a second period, of a region spanned by the set of one or more pixels. As described previously, the set of one or more pixels can span T×V pixels, with T a natural number representative of a number of lines of pixels and V a natural number representative of a number of columns of pixels in the display. In common scenarios, for monolithic flat displays, the region spanned by the set of one or more pixels of the display establishes a region in a backlight source (e.g., a transparent substrate (flexible or rigid) and solid-state light source(s)), wherein the region in the backlight source can have substantially the same area as the region spanned by the set of one or more pixels of the display. At act 920, data is collected; the data indicates illumination intensity of light to be emitted in a region of the backlight source during the second period. In an aspect, the data is determined at least in part by disparate data that conveys at least a portion of an image to be rendered in the display. Such disparate data can be acquired at act 930, in which data indicative of pixel content of at least one pixel of the set of one or more pixels is collected.

At act 940, based at least on one or more of the illumination intensity or the pixel content, a gamma characteristic of the set of one or more pixels of the display is adjusted. The gamma characteristic is adjusted in response to the first period elapsing. In an aspect, the gamma characteristic can be adjusted upon or at substantially the instant at which the first period elapses. In another aspect, the gamma characteristic can be adjusted at a predetermined interval subsequent to the first period elapsing. Adjusting the gamma characteristic includes updating the gamma characteristic during a horizontal blanking period (determined by an HSYNC clock signal) of the display. Updating the gamma characteristic includes determining at least one gamma value and configuring at least one gamma reference voltage corresponding to the gamma value. The adjusting also includes applying the at least one gamma reference voltage to each pixel in the set of one or more pixels. Determining a gamma value can include computing the gamma value through a first predetermined function of the illumination intensity, a second predetermined function of the pixel content, or a third function of the illumination content and pixel content (or pixel data). In the alternative, to reduce complexity and processing load (e.g., number of operations performed by processor(s) 234) determining the gamma value can include acquiring the gamma value from a look-up table retained in a buffer (e.g., memory 234) or one or more memory elements therein (register(s), such as register(s) 237; databases; file(s); etc.). The look-up table can be constructed via the first predetermined function, the second predetermined function, or the third predetermined function. Various look-up tables can be defined and retained in the buffer.

At act 950, light is emitted in the region of the backlight source at the illumination intensity during the second period. In an embodiment, the second period commences after a predetermined interval elapses from initiation of the first period for data writing. For example, for a null or substantially null predetermined interval, the second period and the first period can be concurrent or substantially concurrent. For another example, the magnitude of the predetermined interval causes the second period and the first period to overlap partially. Yet in another example, the magnitude of the predetermined interval causes the second period to be disjoint with the first period, wherein the commencement instant for the second period is a predetermined lag phase (see, e.g., FIG. 4). As described previously, for solid-state source(s) embodied in several of LEDs, emitting light in the region of the backlight source at the illumination intensity includes controlling peak intensity of emitted light from at least one LED of the several LEDs. Moreover, emitting light in the region of the backlight source at the illumination intensity can include energizing, or powering on, the at least one LED according to a PWM time waveform with a predetermined duty cycle and frequency. The PWM time waveform can be phase-shifted with respect to an alternate region of the backlight source.

FIG. 10 is a flowchart of an example method 1000 for synchronizing data writing to a region in an imaging area and backlight illumination in a region of a backlight source according to aspects described herein. In one or more scenarios, the subject example method 1000 embodies act 910. At act 1010, at least one clock signal is acquired. As indicated previously, the at least one clock signal can include VSYNC, HSYNC, various delays or phases, or the like. At act 1020, based on a first clock signal of the at least one clock signal, a first timer is triggered. The first timer clocks completion of data writing to a pixel line in a group of pixels. The group of pixels spans a region of an imaging area. At act 1030, condition of data writing to the group of pixels is assessed. The condition can relate to various aspects of data writing such as data writing fault, data writing rate, degree of completion of data available for writing to the group of pixels, or the like. In an aspect, when the condition is "Incomplete" or otherwise conveys that at least one pixel remains to be written, the first timer is advanced at act 1040, and flow is directed to act 1030. In contrast, when the condition is "Complete" or otherwise conveys that all pixels in the group of pixels have been written, the first timer is reset at act 1050 and at least part of the method flow is directed to act 1020. At act 1060 a second timer is triggered. The second timer clocks a delay from initiation of data writing to the group of pixels. At act 1070, it is determined if the delay has elapsed a predetermined period of time conveyed by a second clock signal of the at least one clock signal. When outcome of the determining act is negative, the second timer is advanced and the method flow is returned to 1070. In contrast, when the outcome of the determining act is affirmative, a period to illuminate a region of a backlight source is triggered at act 1090, wherein the region is related to the region of the imaging area.

FIG. 11 is a flowchart of an example method 1100 for fading luminance characteristics of disparate display areas in a display according to aspects of the subject disclosure. In certain embodiments, such fading provides various advantages such as mitigation of ocular perception of disparate levels of luminance in the disparate display areas. In various embodiments, a gamma regulation module (e.g., gamma regulation component 218) or one or more components therein can implement the subject example method. At act 1110, a set of one or more pixels is identified, wherein the set of one or more pixels spans at least a portion of at least two neighboring regions of an imaging area of the display. Identifying the set of one or more pixels can include retrieving configuration information from a buffer (e.g., memory 234) or memory element(s) therein. In an embodiment, a component (e.g., fade component 822) can identify the set of one or more pixels; such configuration information can be retrieved from the set 828 of one or more fade scale(s) 828. At act 1120, the cardinality of a subset of one or more pixel lines of the set of one or more pixels is acquired, such group that spans an interface region is acquired, wherein the interface region separates a first region and a second region of the at least two neighboring regions. In an aspect, the interface region is adjacent to both the first region and the second region. Acquiring such cardinality can include acquiring data indicative of the cardinality of the set of one or more pixel lines, and processing the data to extract the cardinality. The data can be configuration data and it can be acquired from a buffer (e.g., memory 234) or memory element(s) therein.

At act 1130, for each pixel line in the set of one or more pixel lines, a gamma characteristic of at least one pixel in a current pixel line is adjusted in response to completion of writing data to the current line. The gamma characteristic can be adjusted during a horizontal blanking interval (HSYNC). Adjusting the gamma characteristic can include generating a gamma value for the current line of pixels and, and in response, configuring a gamma reference voltage related (in a one-to-one relationship, for example) to the gamma value. In an aspect, generating such gamma value can be accomplished by computing the gamma value, by reading a look-up table in a memory element (e.g., register). Additionally or alternatively, generating the gamma value can be accomplished by querying a component data manages content of a buffer functionally coupled to the gamma regulation module that implements the subject example method. In certain embodiments, the gamma value can be constant ($\Delta\gamma$) for each pixel line in the set of one or more pixel lines, and it can be applied as an offset a previous gamma value: For cardinality $C_0$, $\gamma_{\kappa+1}-\gamma_\kappa=\Delta\gamma$, with $\kappa=1, 2, \ldots, C_0$, and $\Delta\gamma=\gamma_{II}-\gamma_I$ where $\gamma_I$ is the gamma value corresponding to the first region and $\gamma_{II}$ is the gamma value corresponding to the second region. For each value $\gamma_\kappa$, a related gamma reference voltage $V_\kappa$ is configured.

By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of further illustration and not limitation, RAM can be available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to include, without being limited to including, these and any other suitable types of memory.

The various illustrative logics, logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a group of microprocessors, one or more microprocessors in conjunction with a DSP core, or any other such configuration. Additionally, at least one processor may include, without limited to including, one or more modules operable to or configured to perform one or more of the steps or acts described above.

Further, the steps or acts of a method or algorithm described in connection with the aspects disclosed herein may be embodied directly in hardware; in a software module executed by a processor; or in a combination of the two, such as in a firmware module. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to the processor, such that the processor can read information from, and write information to, the storage medium. In the alternative, the storage medium may be integral to the processor. Further, in some aspects, the processor and the storage medium may reside in an ASIC. Additionally, the ASIC may reside in display equipment. In the alternative, the processor and the storage medium may reside as discrete components, e.g., chipsets, in display equipment. Additionally, in some aspects, the steps or acts of a method or algorithm may reside as one or any combination or set of one or more codes or instructions on a machine-readable medium or computer-readable medium, which may be incorporated into a computer program product.

In one or more aspects, the functions described may be implemented in hardware, software, firmware, or any combination thereof. If implemented in software, the functions may be stored or transmitted as one or more instructions or code on a computer-readable medium or machine-readable medium. Computer-readable media machine-readable media includes both computer storage media and communication media including any medium that facilitates transfer of a computer program from one place to another. A storage medium may be any available media that can be accessed by a computer. By way of example, and not limitation, such computer-readable media can include, without limited to including, RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection may be termed a computer-readable medium. For example, if software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs usually reproduce data optically with lasers. Combinations of the above also are included within the scope of computer-readable media.

What is claimed is:

1. A method, comprising:

synchronizing (a) data writing to a set of pixels in a display during a first period within a video frame, and (b) backlight illumination of a region of the display during a second period, the region of the display is spanned by the set of pixels;

collecting data indicative of illumination intensity of light to be emitted in a region of a backlight source of the display during the second period;

collecting data indicative of pixel content of at least one pixel of the set of pixels;

based at least on one or more of the illumination intensity or the pixel content of the at least one pixel, adjusting a gamma characteristic of the set of pixels within the video frame, where the adjusting includes:

identifying a plurality of pixels of the display that spans at least a portion of at least two neighboring regions of an imaging area of the display;

identifying a subset of two or more pixel lines of the plurality of pixels, the subset spans an interface region that separates a first region and a second region of the at least two neighboring regions; and for at least first and second pixel lines of the subset of pixel lines, updating a gamma characteristic of at least one pixel in response to completion of writing data to a current pixel line, so that a first gamma value for each pixel in the first pixel line is a value based on an offset from a second gamma value for each pixel in the second pixel line.

2. The method of claim 1, further comprising:

emitting light at the illumination intensity during the second period by a group of LEDs associated with the region of the backlight source.

3. The method of claim 1, wherein the synchronizing includes:

triggering a first timer that clocks completion of data writing to a pixel line in the set of pixels; and triggering a second timer that clocks a delay from initiation of data writing to the set of pixels; and triggering the second period to illuminate the region of the display in response to the delay elapsing a predetermined period, wherein the predetermined period is greater than or equal to about zero.

4. The method of claim 1, wherein the adjusting includes:

updating the gamma characteristic during a horizontal blanking period of the display.

5. The method of claim 1, wherein the updating includes:

determining at least one gamma value, wherein the determining includes at least one of computing the at least one gamma value through a predetermined function of the illumination intensity and the pixel content of the at least one pixel of the set of pixels, or acquiring the at least one gamma value from a look-up table retained in a buffer of the display; and configuring at least one gamma reference voltage corresponding to the at least one gamma value.

6. The method of claim 5, wherein the updating further includes:

applying the at least one gamma reference voltage to at least one pixel in the set of pixels.

7. A device, comprising:

an image controller that regulates pixel circuitry comprising a plurality of pixels partitioned into a first set of regions;

a gamma regulation component that adjusts, within a video frame, a gamma characteristic of at least one region in the first set of regions based at least on brightness of light emitted by a backlight source, wherein the backlight source is partitioned into a second set of regions commensurate with the first set of regions, where the gamma regulation component is configured to:

identify a set of pixels that spans at least a portion of at least two neighboring regions in the first set of regions;

identify a subset of the set of pixels, wherein the subset has at least one pixel line that spans an interface region that separates a first region and a second region of the at least two neighboring regions; and for the at least first and second pixel lines of the subset of pixel lines, update a gamma characteristic of at least one pixel in response to completion of writing data to a current pixel line, so that a first gamma value for each pixel in the first pixel line is a value based on an offset from a second gamma value for each pixel in the second pixel line.

8. The device of claim 7, wherein the gamma regulation component includes a synchronization component that acquires at least two clock signals and at least one phase delay, the at least two clock signals are for driving data supply to the plurality of pixels, wherein the plurality of pixels is arranged into a group of pixel lines.

9. The device of claim 8, wherein the synchronization component:

triggers a first counter that accounts for a current number of pixel lines that have been supplied data; and triggers a second counter in response to the first counter having a value indicative of a predetermined number of pixel lines in the at least one region.

10. The device of claim 9, wherein in response to the first counter having the value indicative of the predetermined number of pixel lines in the at least one region, the synchronization component conveys a signal to produce at least one gamma value and at least one gamma reference voltage related to the at least one gamma value.

11. The device of claim 10, wherein the at least one gamma value comprises a set of values for a set of respective colors; and the at least one gamma reference voltage comprises a set of voltages for respective values in the set of values for the set of respective colors.

12. The device of claim 10, wherein the gamma regulation component includes a reference voltage generator that:

receives the signal; and generates the at least one gamma value and the at least one gamma reference voltage related to the at least one gamma value.

13. The device of claim 12, wherein the reference voltage generator produces the at least one gamma value and the at least one gamma reference voltage related to the at least one gamma value prior to the second counter expiring, wherein the second counter expires when attaining a preconfigured count dictated in part by a first clock signal of the at least two clock signals, wherein the first clock signal is horizontal synchronization.

14. The device of claim 13, wherein the reference voltage generator applies the at least one gamma reference voltage to each pixel in the predetermined number of pixel lines in the at least one region prior to the second counter expiring.

15. The device of claim 7, wherein the gamma regulation component is configured to produce at least one gamma value and at least one gamma reference voltage for a single pixel line of the at least one pixel line in response to completion of writing data to the single pixel line.

16. The device of claim 15, wherein the component applies the at least one gamma reference voltage to at least one pixel in the single pixel line prior to expiration of a blanking time interval dictated by one clock signal of the at least two clock signals.

17. The device of claim 12, wherein the reference voltage generator is functionally coupled to one or more pixels of the plurality of pixels via one or more of at least one digital-to-analog converter, or one or more pins.

18. A liquid crystal display, comprising:

pixel circuitry comprising a plurality of pixels partitioned into a set of regions of an imaging area of the liquid crystal display;

backlight circuitry comprising a set of light emitting diodes (LEDs) arranged in groups that illuminate respective areas of a backlight source of the liquid crystal display, an area illuminated by a group of LEDs is associated with a region in the set of regions;

a controller that regulates, within a video frame, a gamma characteristic of the region in the set of regions based at least on an illumination intensity of light emitted in the area illuminated by the group of LEDs, where the controller is configured to:

identify a plurality of pixels that spans at least a portion of at least two neighboring regions of the imaging area of the liquid crystal display;

identify a subset of two or more pixel lines of the plurality of pixels, the subset spans an interface region that separates a first region and a second region of the at least two neighboring regions; and, for at least first and second pixel lines of the subset of pixel lines, update a gamma characteristic of at least one pixel in response to completion of writing data to a current pixel line, so that a first gamma value for each pixel in the first pixel line is a value based on an offset from a second gamma value for each pixel in the second pixel line.

19. The liquid crystal display of claim 18, wherein to regulate the gamma characteristic of the region, the controller updates the gamma characteristic of the region during a horizontal blanking period of the liquid crystal display.

20. The liquid crystal display of claim 19, wherein to update the gamma characteristic of the region, the controller establishes a gamma value based at least on one or more of the illumination intensity or at least one value of at least one pixel in the region.

21. The liquid crystal display of claim 20, wherein to update the gamma characteristic of the region, the controller configures a gamma reference voltage related to the gamma value; and applies the gamma reference voltage to at least one pixel of the region.

* * * * *

UNITED STATES PATENT AND TRADEMARK OFFICE

CERTIFICATE OF CORRECTION

PATENT NO. : 8,917,231 B2
APPLICATION NO. : 12/972380
DATED : December 23, 2014
INVENTOR(S) : Hempson et al.

It is certified that error appears in the above-identified patent and that said Letters Patent is hereby corrected as shown below:

In the Specification

Column 1 Line 55 delete "$I_{1um}$" and insert --$I_{lum}$--, therefor.

Column 6 Line 55 delete "—$V_{Ref}{}^{(V2)}$ (Y)," and insert -- --$V_{Ref}{}^{(V1)}$ (Y),--, therefor.

Column 6 Line 63-64 delete "(e.g., $V_{ref}{}^{V1)}$ (Y), $V_{ref}{}^{V2)}$ (Y), $V_{ref}{}^{V3)}$ (Y)...$V_{ref}{}^{VB)}$ (Y))" and insert --(e.g., $V_{ref}{}^{(V1)}$ (Y), $V_{ref}{}^{(V3)}$ (Y)...$V_{ref}{}^{(VB)}$ (Y))--, therefor.

Column 7 Line 4 Delete "(e.g., $V_{ref}{}^{V1)}$ (Y), $V_{ref}{}^{V2)}$ (Y), $V_{ref}{}^{V3)}$ (Y)...$V_{ref}{}^{VB)}$ (Y)" and insert --(e.g., $V_{ref}{}^{(V1)}$ (Y), $V_{ref}{}^{(V2)}$ (Y), $V_{ref}{}^{(V3)}$ (Y)...$V_{ref}{}^{(VB)}$ (Y))--, therefor.

Column 9 Line 1 Delete "$V_{ref}{}^{(Red)}$ ($Y_r$)," and insert --$V_{ref}{}^{(Red)}$ ($Y_R$),--, therefor.

Signed and Sealed this
Nineteenth Day of May, 2015

Michelle K. Lee

Michelle K. Lee
*Director of the United States Patent and Trademark Office*